US006829856B1

(12) United States Patent
Moorman

(10) Patent No.: US 6,829,856 B1
(45) Date of Patent: Dec. 14, 2004

(54) PORTABLE ARM SUPPORT

(76) Inventor: Charles W. Moorman, 1008 Dunning Dr., Mesquite, TX (US) 75149

( * ) Notice: Subject to any disclaimer, the term of this patent is extended or adjusted under 35 U.S.C. 154(b) by 0 days.

(21) Appl. No.: 10/001,482

(22) Filed: Nov. 1, 2001

Related U.S. Application Data

(63) Continuation-in-part of application No. 60/244,906, filed on Nov. 2, 2000.

(51) Int. Cl.[7] ..... F41C 27/22
(52) U.S. Cl. ..... 42/94; 248/118; D22/199
(58) Field of Search ..... 42/94; 248/118; D22/199

(56) References Cited

U.S. PATENT DOCUMENTS

| | | | | | |
|---|---|---|---|---|---|
| 889,658 | A | * | 6/1908 | Brunaugh, Jr. | 42/94 |
| 1,103,824 | A | * | 7/1914 | Page | 42/94 |
| 1,348,910 | A | * | 8/1920 | Valnch | 42/1.11 |
| 3,200,528 | A | * | 8/1965 | Christensen | 42/94 |
| 3,390,477 | A | * | 7/1968 | Galbraith | 248/118 |
| 3,609,902 | A | * | 10/1971 | Casull | 42/62 |
| 3,632,087 | A | * | 1/1972 | Phillips | 254/88 |
| 3,783,799 | A | * | 1/1974 | Dupuis | 108/19 |
| 3,894,496 | A | * | 7/1975 | Phillips et al. | 108/50.11 |
| 4,575,964 | A | | 3/1986 | Griffin | |
| 4,609,192 | A | * | 9/1986 | Bratcher | 482/142 |
| 4,844,390 | A | | 7/1989 | Duke | |
| 5,018,294 | A | | 5/1991 | McGuffee | |
| 5,111,983 | A | * | 5/1992 | Simmons et al. | 224/258 |
| 5,194,678 | A | * | 3/1993 | Kramer | 42/94 |
| 5,351,867 | A | * | 10/1994 | Vest | 124/89 |
| 5,410,835 | A | * | 5/1995 | Vetter | 42/94 |
| 5,491,920 | A | | 2/1996 | McCullers | |
| 5,738,256 | A | * | 4/1998 | Goff et al. | 224/185 |
| 5,775,021 | A | * | 7/1998 | Weiss | 42/95 |
| 5,778,589 | A | * | 7/1998 | Teague | 42/94 |
| 5,819,461 | A | * | 10/1998 | Killian | 42/94 |
| 6,016,620 | A | * | 1/2000 | Morgan | 42/94 |
| 6,112,448 | A | * | 9/2000 | Gray et al. | 42/85 |
| 6,267,335 | B1 | * | 7/2001 | Barrett | 248/118 |

* cited by examiner

*Primary Examiner*—Michael J. Carone
*Assistant Examiner*—Bret Hayes
(74) *Attorney, Agent, or Firm*—Mark W. Handley; Chauza & Handley, L.L.P.

(57) ABSTRACT

A portable arm support (10) for attaching to a user to support or steady firearms, cameras, binoculars, or the like. The portable arm support (10) includes a saddle (12) having fastening straps (20) which secure the saddle (12) to the forearm of the user, and a belt pocket (42) which is mounted to the belt of a user. A support tube (14) is pivotally secured to the saddle (12) and is telescopically extensible for adjusting an overall length of the support tube (14) to extend from the saddle (12) and into the belt pocket (42). The support tube (14) is telescopically adjustable to extend and then latch in an extended position with the lower end of the support tube (14) disposed within the cavity (60) of the belt pocket (42) to support the saddle (14) in fixed relation to the belt pocket (42).

2 Claims, 3 Drawing Sheets

PORTABLE ARM SUPPORT

CROSS-REFERENCE TO RELATED APPLICATIONS

The present invention is a continuation-in-part of and claims priority to U.S.Provisional Patent Application Ser. No. 60/244,906, which was filed on Nov. 2, 2000, entitled "Moorman's Steady Rest," and invented by Charles W. Moorman.

TECHNICAL FIELD OF THE INVENTION

The present invention is concerned with the field of portable supporting devices to support objects and the arm of a user, and in particular, with a portable arm support which is attached to the forearm of a user to support, or steady, hand-held objects such as firearms, cameras, binoculars, or the like.

BACKGROUND OF THE INVENTION

A common problem encountered when using firearms, cameras, binoculars (especially high-powered units), and other devices that require aiming or focusing for successful use thereof is the requirement to maintain such devices in a steady and stable position. Users of these devices have developed various body positions and articles of manufacture in order to assist the body in providing a stable and unwavering means of support during use of such devices. For instance, in using a firearm many enthusiasts hold a hand gun with two hands, or assume a kneeling or lying position upon a ground or support surface when firing a rifle. While these positions aid in steadying a firearm somewhat, they do not completely eliminate the tendency for a hand-held firearm to wobble or drift from a desired aim or focus. A variety of apparatuses are available to steady firearms and other equipment. However, many of these units are cumbersome and unwieldy and are difficult to transport, assemble, disassemble, and store, such as various tripods and other steadying apparatuses.

Numerous designs for arm supports or other forms of stabilizing devices intended for use with firearms, cameras, binoculars and the like have been provided in the prior art. Even though these designs may be suitable for the specific individual purposes to which they address, they would not be suitable for the purposes of the present version of the invention as such devices are elaborate in design and construction; cumbersome to use; or require a user to assume one or several positions, such as kneeling, which may limit their applicability to some users or certain types of devices requiring aiming or focusing for use thereof. These patents are exemplified by U.S. Pat. No. 4,575,964, entitled "Gun Rest," and issued to Griffin on Mar. 18, 1986; U.S. Pat. No. 4,844,390, entitled "Hunter's Portable Arm Rest," and issued to Duke on Jul. 4, 1989; U.S. Pat. No. 5,018,294, entitled "Steady Hand," and issued to McGuffee on May 28, 1991; U.S. Pat. No. 5,491,920, entitled "Adjustable Firearm Brace," and issued to McCullers on Feb. 20, 1996; and U.S. Pat. No. 6,016,620, entitled "Arm and Hand Gun Support Apparatus," and issued to Morgan on Jan. 25, 2000.

As such, it may be appreciated that there is a continuing need for a new and improved arm support for use in supporting hand-held objects which require steady aiming in a particular direction, such as firearms, cameras, binoculars and other devices, wherein such an arm support is constructed with a minimum number of components and can be used in a variety of positions. What is needed then to overcome the aforementioned difficulties of using firearms, cameras, binoculars, and the like (i.e. the necessity of stabilizing such devices for aiming and focusing) and the disadvantages of available steadying apparatuses is the provision of a lightweight, portable arm support which is comprised of a minimum number of components and which can be releasably attached to the forearm of a user at one end and supported by a belt pocket at a second end so that a firearm, camera, and binoculars can be supported thereon and aimed or focused without drifting, wobbling, or otherwise moving from a desired position.

SUMMARY OF THE INVENTION

A portable arm support is provided which is releasably attached to the forearm of a user to provide a steady rest for supporting or steadying firearms, cameras, binoculars, or the like. The portable arm support is comprised of a saddle, fastening straps, a support tube which is extensible and pivotally secured to the saddle, and a belt pocket. The fastening straps are provided by two leather straps with buckles, which are affixed at each end of the saddle. The saddle is preferably formed of leather, and includes a first saddle member and a second saddle member. The second saddle member is smaller than the first saddle member and attached to the larger first saddle member by rivet fasteners. The second saddle member is formed with a swivel aperture to which one end of the support tube is secured in rotating engagement therein. The support tube is constructed of an outer tub and an inner tube, which is telescopically engaged within the outer tube. The outer tube, upon which a rubber tip is secured onto an unattached end, can be extended from the outer tube and maintained in a position of half extension or full extension therefrom by spring-biased pins.

During use, the saddle is secured to a forearm of a user by wrapping the leather straps around the forearm and engaging the buckles to opposing ends of the straps. The support tube is rotated and extended if necessary in order to allow insertion of the rubber tip into a cavity of the belt pocket, which is releasably secured to the belt of the user. Once the saddle is attached to the forearm and supported by the support tube, an object, such as a rifle, for instance, can be stabilized by placing the barrel of the rifle onto a portion of the saddle adjacent to the hand of the user for support thereof. Once positioned thereon, the rifle barrel can be grasped by the hand proximate to the saddle and pointed to a desired target in a stable manner.

One object of the present invention is to provide a low-cost, easy-to-manufacture, and easy-to-market portable arm support.

Another object of the present invention is to provide an easy-to-use and versatile portable arm support.

Another object of the present invention is to provide a portable arm support that is comprised of a leather saddle, an extensible tube rotatingly attached at one end to said saddle, two leather straps with buckles affixed to opposing ends of said saddle, and a belt pocket.

Another object of the present invention is to provide a portable arm support having a saddle which is releasably attached to the forearm of a user with the forearm supported at a desired position by an extensible tube, which is rotatingly attached at one end to the saddle and inserted at an opposing end into a belt pocket worn by the user. As such, a firearm, camera, or binoculars or other device requiring aiming or focusing for successful use thereof can be supported or stabilized by the instant invention when donned by a user in the aforementioned manner.

DESCRIPTION OF THE DRAWINGS

The foregoing and other objects, features and advantages of the invention will become more fully understood from the following description of the preferred embodiment of the invention as illustrated in the accompanying drawings in which like reference characters refer to the same parts throughout different views.

DETAILED DESCRIPTION OF THE INVENTION

Figure 1:
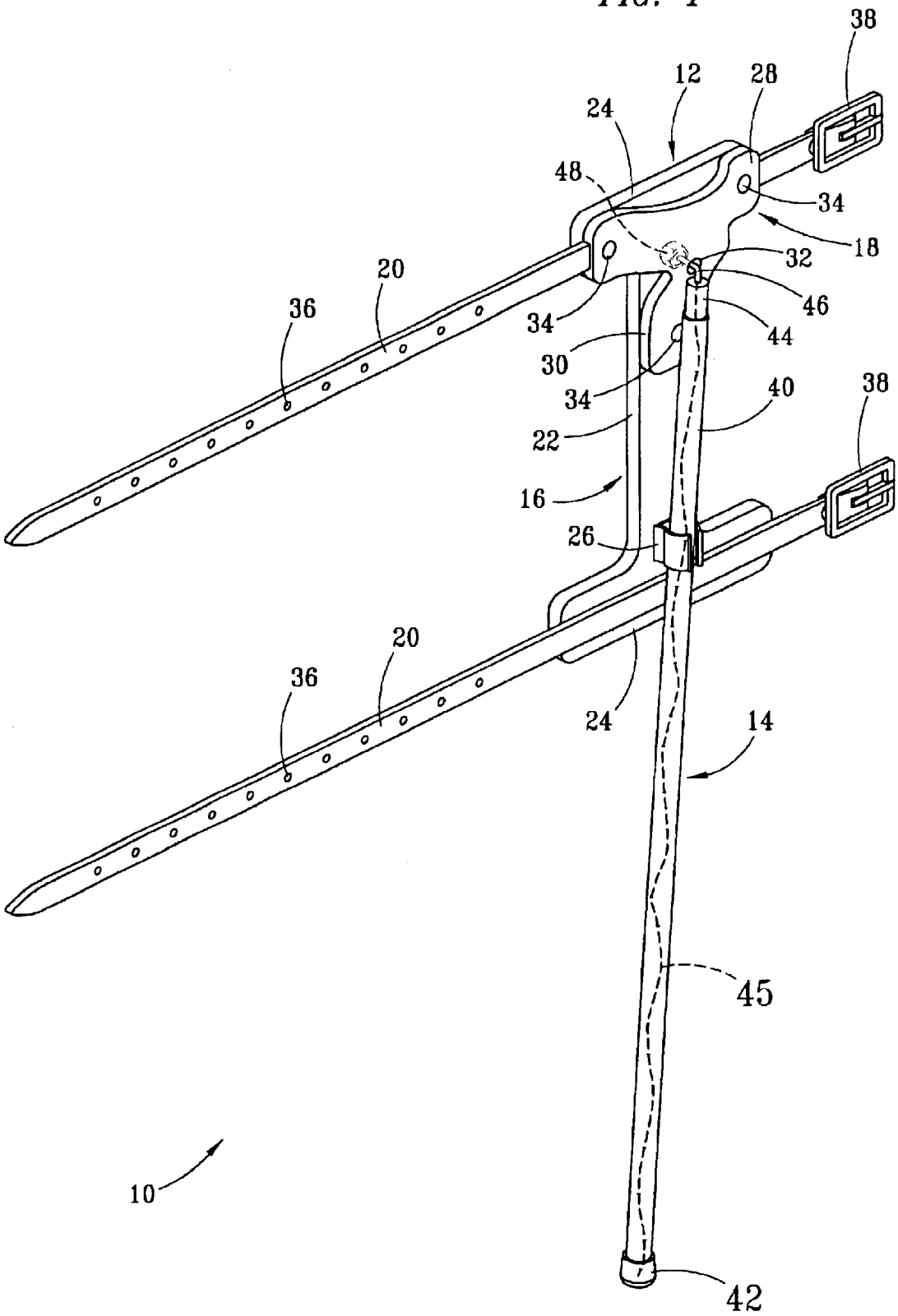
FIG. 1 is a perspective view of a steady rest made in accordance with the present invention.

Referring now to the drawings and, in particular, to FIG. 1 wherein there is illustrated a typical embodiment of the steady rest 10 for use with firearms, cameras, binoculars or other devices that require aiming or focusing. The present version of the invention 10 consists of a leather saddle 12, an extensible support tube 14 pivotally attached at one end to the saddle 12, and two elongate leather straps 20. The leather saddle 12 is further constructed of a first saddle member 16 and a second saddle member 18. The first saddle member 16 is larger than the second saddle member 18. The first saddle member 16 is fabricated into an I-shaped configuration, having a central, elongate middle portion 22 and two end portions 24 that are disposed such that longitudinal lengths of the two end portions are disposed in perpendicular relation to a longitudinal length of the middle portion 22 and in parallel relation to each other. A flexible, metal retaining clip 26 is generally U-shaped and affixed to the first saddle member 16 of the saddle 12 at the junction of the middle portion 22 and a lower end portion 24, with the term "lower" in this description designating that portion which is located toward the unattached end of the support tube 14. The retaining clip 26 releasably secures to the support tube 14 to releasably secure the tube 14 to the saddle 12.

The second saddle member 18 is preferably formed in a T-shaped configuration, which comprises an upper portion 28 and a lower portion 30. A longitudinal length of the lower portion 30 is disposed in perpendicular relation to a longitudinal length of the upper portion 28. A swivel aperture 32 extends through the second saddle member 18 at the juncture of the upper portion 28 and the lower portion 30. A series of rivet fasteners 34 affixes the second saddle member 18 to the first saddle member 16.

Referring again to FIG. 1, the leather straps 20 are narrow and elongate in shape and construction. The two major portions of the leather straps 20 have a series of apertures 36 formed therein. A buckle 38 is rotatingly attached to the opposite ends of the straps 20 than the end into which the apertures 36 are formed. The extensible support tube 14 is comprised of an outer tube 40 with rubber tip 42 affixed to an unattached end thereof and an inner tube 44, with the tube sections 40 and 44 secured together in a telescoping engagement. An attachment member 45 is provided by a flexible line which extends between the tube sections 40 and 44, to prevent the tube sections 40 and 44 from telescopically moving until the tube sections 40 and 44 are pulled fully apart, such that the inner tube 44 cannot be fully removed from within the outer tube 40. The flexible line of the attachment member 45 is preferably provided by a length of eighty-five pound test nylon cord, which is attached to opposite ends of the telescopically extendible support tube 14.

Figure 2:
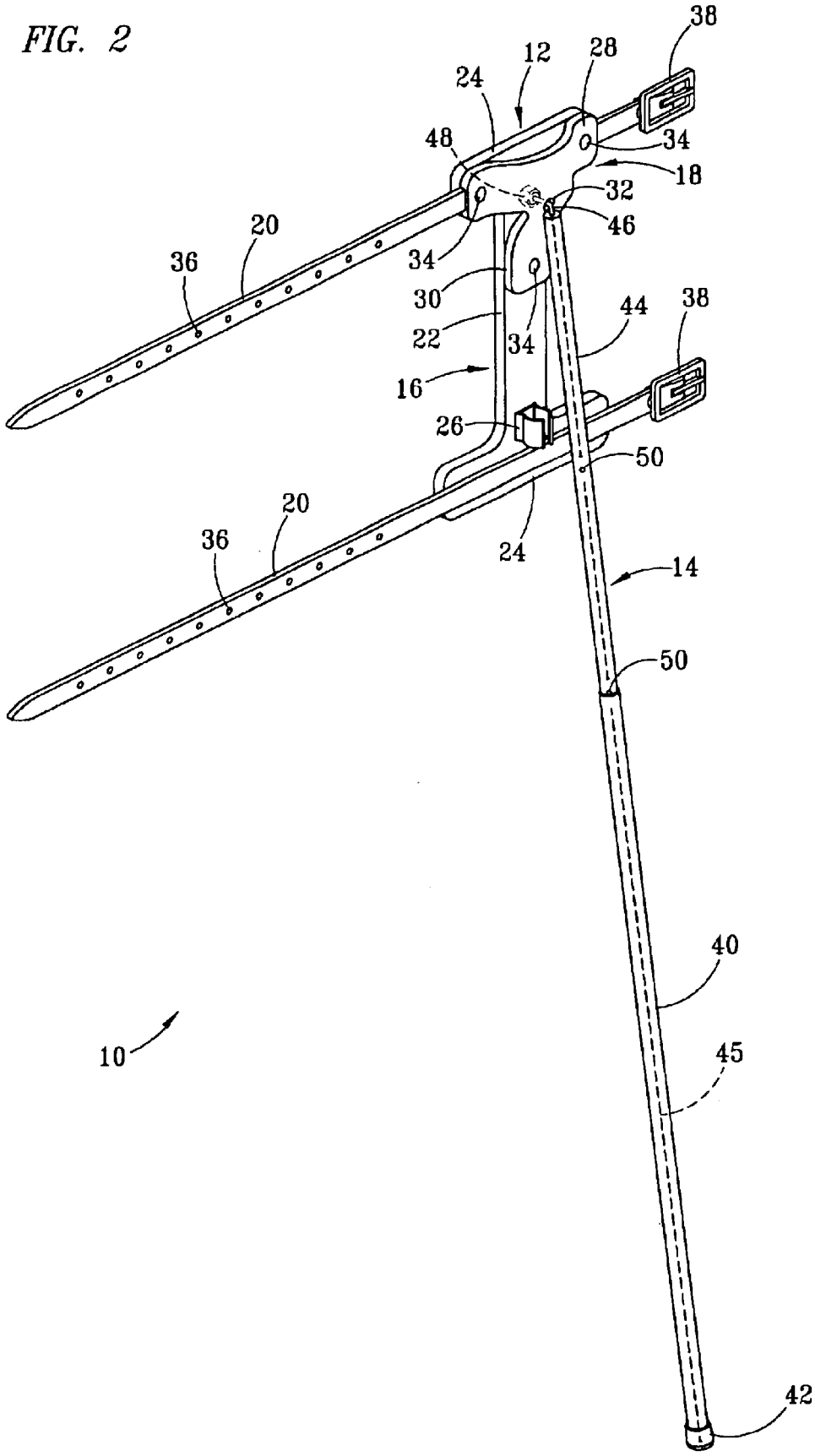
FIG. 2 is a perspective view of the steady rest with a supporting tube configured into a fully extended position.

A swivel pin 46 and swivel anchor 48 are attached to the visible end of the inner tube 44. The swivel pin 46 rotates or pivots within the swivel aperture 32 of the second saddle member 18. Preferably, the swivel anchor 48 is free-floating between the first saddle member 16 and the second saddle member 18, that is, it is not fixedly secured to either. The swivel anchor 48 constructed of a size greater than that of the swivel aperture 32 in order to prevent the swivel anchor 48 from passing through the aperture 32, which would cause the tube 14 to disengaging from the saddle 12. In other embodiments, the swivel 48 anchor may be provided by a universal joint which is fixedly attached to the saddle 12, such as to one of the first or second saddle members 16 and it. As the inner tube 44 is directly attached in pivoting engagement to the second saddle member 18, the outer tube 40 extends and retracts in relation to the inner tube 44. As shown in FIG. 2, the outer tube 40, separated from the clip 26, is fully extended in relation to the inner tube 44 and is maintained in extension by one of two spring-biased pins 50. A first spring-biased pin 50, located farthest from the swivel pin 46, maintains the outer tube 40 in the fully-extended position (as shown), and a second spring-biased pin 50, located between the swivel pin 46 and the first pin 50, maintains the outer tube 40 in a partiallyextended position.

Figure 3:
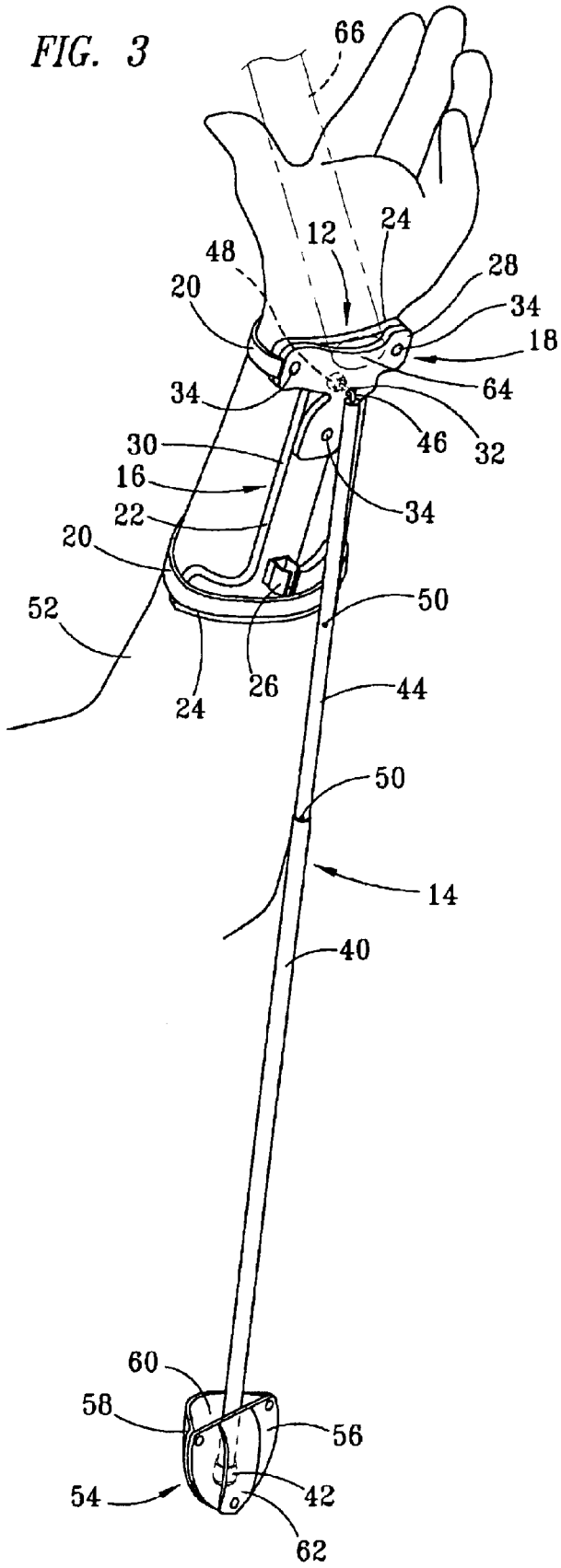
FIG. 3 is a perspective view of the steady rest releasably secured to a forearm of a user with an end of the support tube positioned into a belt pocket.

In FIG. 3, the portable arm support 10 is illustrated as releasably attached to the forearm 52 for receipt and support of a device requiring aiming or focusing. The leather straps 20 are wrapped around the forearm 52 with the buckles 38 engaging appropriate apertures 36. As the saddle 12 is pulled by the straps 20 being wrapped around the forearm 52, the upper portion 28 of the second saddle member 18 is raised into an arch, such that a central portion 64 of the upper portion 28 defines a steady rest, which is disposed between the rivets 34 and adjacent to the aperture 32, provides a steady rest, or a region of support, for an object 66 which is being supported to rest directly against. The object 66 schematically depicts a device being supported by engaging the rest surface 64 defined by the second saddle member 18. In some instances, the object 66 may represent the hand of the user's other arm than that to which the portable arm rest 10 is mounted, such as in cases of firing a hand gun. The forearm 52 and the rest surface 64 are maintained in such a position by rotating and extending the support tube 14 as shown and stabilizing the support tube 14 in such position by inserting the rubber tip 42 on the unattached end of the outer tube 40 into a belt pocket 54. The belt pocket 54 includes a rear member 56 and front member 58 which enclose a hollow, or cavity, 60 into which the rubber tip 42 is inserted. The belt pocket further includes a belt fastener 62 which is preferably provided by a strap 62 that is affixed to the rear member 56 for securing the belt pocket 54 to a belt (not shown) of a user. Once the steady rest 10 is attached and configured as illustrated, a firearm, for instance is supported thereon by the firearm's barrel resting directly against the arch of the second saddle member 18 as described previously and held in place as the left hand is wrapped around said barrel. The stock of the firearm is pressed against the shoulder of a user and the trigger is actuated by the right hand (not shown) of the user.

Although the preferred embodiment has been described in detail, it should be understood that various changes, substitutions and alterations can be made therein without departing from the spirit and scope of the invention as defined by the appended claims.

What is claimed is:

1. A portable support for attaching to a user, comprising in combination:

a saddle adapted for being fixedly secured to a forearm of a user, said saddle having an end portion which is disposed adjacent a band of the user;

fastening straps secured to and extending on opposite sides of said saddle, a first end of said straps having buckles and a second end of said straps having apertures for securing said buckles to said second end of said straps to secure said saddle to the forearm of the user;

a belt pocket defining an upwardly facing cavity and having a belt fastener strap mounted to one side of said belt pocket;

a support tube pivotally secured to said saddle and telescopically extensible for adjusting an overall length of said support tube to extend from said saddle and into said belt pocket;

wherein said support tube is telescopically adjustable to extend and then latch in an extended position with said lower end of said support tube disposed within said cavity of said belt pocket to support said saddle in fixed relation to said belt pocket;

wherein a portion of said first and second saddle member defines a steady rest directly engaging against an object being supported in the hand of a user, to provide further support for the object; and wherein the support tube comprises inner and outer tube sections, said inner tube section slidably secured within said outer tube section for telescolically extending in sliding relation therewith to selectively adjust an overall length of said support tube, an attachment member which extends between said inner and outer tube sections to prevent said inner and outer tube sections from telescopically moving in sliding relation until said tube sections are pulled fully apart such that said inner tube section cannot be fully removed from within said outer tube, and wherein said attachment member comprises flexible line which is attached to opposite ends of said inner and outer tube sections.

2. The portable arm support according to claim 1, further comprising:

a generally U-shaped, flexible, metal retaining clip fixedly secured to said first saddle member for receiving said support tube, said retaining clip being of a size for releasably securing said support tube to said first saddle member when said support tube is disposed within said retaining clip;

said first saddle member being of a larger size than said second saddle member and being of an I-shaped configuration, having a central, elongate middle portion end two end portions that are disposed such that longitudinal lengths of said two end portions are disposed in perpendicular relation to a longitudinal length of said middle portion and in parallel;

said second saddle member being of a T-shaped configuration, which comprises an upper portion and a lower portion, a first longitudinal length of said lower portion being disposed in perpendicular relation to a second longitudinal length of said upper portion;

a swivel aperture extending through said second saddle member proximate a juncture of said upper and lower portions;

a swivel pin having first and second ends and being formed into an L-shaped configuration, said first end of said swivel pin being fixedly secured to an upper end of said support tube and said swivel pin extending through said swivel aperture in said saddle member;

a swivel anchor secured to said second end of said swivel pin, said swivel anchor being of a larger size than said swivel aperture in said second saddle member for securing said swivel pin within said swivel aperture, which pivotally secures said support tube to said saddle.

* * * * *